US005238485A

United States Patent [19]

Shubert

[11] Patent Number: 5,238,485

[45] Date of Patent: Aug. 24, 1993

[54] METHOD FOR THE ASSAY AND RECOVERY OF PRECIOUS METALS

[76] Inventor: Roland H. Shubert, 1664 Bachan Ct., Reston, Va. 22090

[21] Appl. No.: 995,005

[22] Filed: Dec. 22, 1992

Related U.S. Application Data

[63] Continuation-in-part of Ser. No. 649,589, Jan. 18, 1991, abandoned.

[51] Int. Cl.[5] ..... C22B 11/00

[52] U.S. Cl. ..... 75/421; 75/423; 75/631; 75/632; 75/633; 75/637; 204/109

[58] Field of Search ..... 75/631, 632, 633, 637, 75/421, 423; 204/109

[56] References Cited

U.S. PATENT DOCUMENTS 3,833,353 9/1974 Taylor ..... 75/631

FOREIGN PATENT DOCUMENTS 4685963 9/1979 South Africa ..... 75/631

*Primary Examiner*—Melvyn J. Andrews

[57] ABSTRACT

Complex ores of the precious metals which also contain iron spinels and similar compounds are assayed and their precious metals content is extracted by subjecting the ores or concentrates thereof together with an iron-embrittling agent to a pyrometallurgical process which reduces at least a major portion of the iron compounds to liquid metallic iron. The liquid iron serves as a collector metal for the precious metals and, after cooling, the iron is brittle and easily comminuted and can be separated from the precious metals through use of either an electrolytic process or a selective chemical dissolution of the iron and other base metals leaving the precious metals available for analysis and recovery.

20 Claims, No Drawings

METHOD FOR THE ASSAY AND RECOVERY OF PRECIOUS METALS

CROSS-REFERENCE TO RELATED APPLICATIONS

This application is a continuation-in-part of U.S. patent application Ser. No. 07/649,589 which was filed on Jan. 18, 1991, now abandoned.

BACKGROUND OF THE INVENTION

1. Field of the Invention

This invention relates generally to the assay and recovery of precious metals.

More specifically, this invention relates to a method for the extraction of precious metals from complex ores and to their assay.

In one specific embodiment, this invention relates to the extraction of gold and platinum group metals from non-sulfidic placer ores and their concentrates.

2. Description of the Related Art

Fire assay has been one of the most widely used and most highly trusted techniques for the assay of ores and concentrates for gold, silver and the platinum group metals. In theory, the fire assay for precious metals depends primarily upon the solubility of the precious metals in molten metallic lead and upon their insolubility in slags of suitable composition. A complete separation of molten lead containing precious metals from slag is easily accomplished because of the large difference in specific gravity between the two liquids.

The fire assay, as it is typically carried out, is a two step process; the first step being a fusion and the second being cupellation. In the fusion step of the assay, a quantity of the sample, usually an ore or ore concentrate, is pulverized and mixed in a crucible with litharge, a reducing agent, and suitable fluxes so that the mixture will fuse at an easily attained temperature. Litharge, which is lead monoxide, is the source of metallic lead which serves to alloy with the precious metals. It also acts as a readily fusible basic flux. The reducing agent is typically flour or corn meal and serves to reduce a part of the litharge to metallic lead. It also functions to reduce certain metal oxides in the sample, particularly iron oxides, from a higher to a lower state. The fluxes used are selected to combine with the gangue portion of the ore sample to produce a relatively low melting point slag and so depend upon the composition of the gangue constituents. If the gangue is composed primarily of silica, which is an acid mineral, then basic fluxes such as lime, magnesia, sodium hydroxide, potassium carbonate, and others are employed. If, on the other hand, the gangue minerals are basic as are the lower oxides of iron and the oxides of manganese, sodium and potassium, then an acid flux such as silica or borax is used. Other fluxing agents are often added to modify the slag properties. Fluorspar, for example, increases the fluidity of most slags.

As the temperature of the charge is raised, the reducing agent reacts with part of the litharge to form molten metallic lead. That reaction begins at a temperature of about 500° to 550° C. Borax begins to melt at about the same temperature and forms fusible, glassy compounds with basic minerals of the ore charge and with basic flux constituents. At a somewhat higher temperature, on the order of 700° C., lead oxide and silica start to combine and a viscous slag is formed. It is desirable to hold the charge near the slag formation temperature for a period of time long enough to decompose the ore particles and to allow the globules of metallic lead to alloy with the precious metals. Thereafter, the temperature is raised to a point where the slag is no longer viscous but is thin and fluid so as to allow ready settling of the lead globules to the bottom of the crucible. The maximum temperature attained during the fusion is ordinarily no higher than about 1,100° C. At the end of the fusion, the molten mixture of metallic lead and slag is poured into a conical mold and is allowed to cool. A lead button, containing the precious metals, forms at the bottom of the mold and is readily separated from the glassy slag which contains the fluxes and the balance of the ore sample.

After separation from the slag, the lead button is subjected to a process called cupellation to separate the precious metals from the lead. Cupellation consists of an oxidizing fusion in a shallow, porous dish called a cupel, usually made of bone ash, which will absorb molten litharge but is impermeable to molten lead. The lead is oxidized at a temperature above the melting point of lead oxide which is mostly absorbed by the cupel and partly volatilized. At the end of the cupellation, after the lead has been driven off, there remains on the cupel a bead containing the precious metals. The bead is weighed and silver contained in the bead is parted from the gold and platinum metals using dilute nitric acid. The metal remaining is annealed and is then analyzed by various techniques to determine the proportions of the precious metals.

It is coming to be recognized that there exists many ores which are very difficult to assay with any degree of confidence using fire assay techniques or by chemical digestion using aqua regia and other powerfully oxidizing reagents followed by gravimetric or instrumental analysis of the extract. Such ores have been referred to by a variety of names including refractory ores, complex ores, unconventional ores, nonassayable ores and the like. Further, ores which are difficult to assay are almost always equally difficult to process for the recovery of contained precious metal values.

One approach to the recovery of precious metals from complex ores is set out in U.S. Pat. No. 4,892,631 to Merwin White. The process disclosed in that patent comprises the fusion of an ore in an electric arc furnace with fluxes and a base metal collector to which an precious metal inquart has been added. The base metal preferably is copper and the precious metal inquart is silver. Fluxes are used to produce an essentially neutral slag containing sodium, calcium, iron and aluminum gangue components of the ore as silicates. Precious metals released by the fusion transfer into the silver-inquarted copper. That copper product is then used as the anode of an electrolytic cell to plate the copper upon a cathode and to leave an anode residue comprising the precious metals. Copper plated upon the cathode may be recycled as the collector in a succeeding furnace charge.

The patent states that the optimum ratio by weight of the ore being smelted to the copper collector metal used is about 1:1. At that ratio, operation of the process would require that a ton of copper is subjected to electrolytic refining for each ton of ore smelted representing a considerable cost to the process.

It is also known to use other collector metals in the smelting of non-magnetic flotation or gravity concentrates containing platinum group metals. One such process is described in published South African Patent Application No. 78/2907 entitled "Process for Extraction of Platinum Group Metals from Chromite Bearing Ore". That process utilizes a high intensity wet magnetic separation to remove magnetic chromite from the non-magnetic platinum metal concentrate to thereby avoid reaction of chromite with carbon during the smelting step to form ferrochrome which alloys with platinum group metals. The smelting step itself comprises the formation of a furnace charge containing the non-magnetic platinum-containing concentrate together with collector materials for the platinum group metals, activators to improve the collection efficiency, and appropriate fluxes. The charge is smelted in a high intensity heating furnace, for example a plasma arc furnace, to form a slag layer and a layer containing collector material and platinum group metals. Collector material useful in the process comprises metals including copper, nickel, cobalt, iron, lead, zinc and mixtures thereof. The collector metals in an amount between about 3% and 10% by weight of the concentrates are added to the charge in metallic form or as the oxide or hydroxide which then undergoes reduction during the smelting step.

SUMMARY OF THE INVENTION

Precious metals including gold and platinum group metals are extracted for assay and recovery from complex ores and ore concentrates containing iron compounds by means of a pyrometallurgical process in which a collector metal fraction comprising iron is generated from the ore or concentrate itself. A brittleness inducing metal, which may be a component of the ore or concentrate, is included within the furnace The ore or concentrate is subjected to fusion in the presence of a brittleness inducing metal at reducing conditions sufficiently severe to reduce at least a part of the iron-containing compounds in the ore to metallic iron and at a temperature sufficiently high to obtain and maintain the reduced metallic iron in liquid form. Precious metals, especially platinum group metals, report to the iron which separates from the slag-forming gangue portion of the ore by virtue of its substantially higher specific gravity. The iron fraction, after cooling and solidification, is highly crystalline and brittle and may be easily comminuted for further processing. That further processing may comprise electrorefining in which the iron is used as the anode of an electrolytic cell. Iron is dissolved and is plated onto a cathode while precious metals remain as an anode sludge. Alternatively, that further processing may comprise chemical dissolution using reagents such as those mineral acids which dissolve the base metals but do not appreciably solubilize the precious metals. The residue from either electrorefining or chemical dissolution is then subjected to analysis for precious metals by conventional gravimetric, chemical, and instrumental techniques.

Hence, it is an object of this invention to extract and assay precious metals contained in complex ores.

It is another object of this invention to improve upon fire assay techniques for the extraction and assay of precious metals from complex ores which contain iron compounds.

Yet another object of this invention is to provide a method for the extraction and assay of platinum group metals from iron oxide-containing placer concentrates.

Other objects of this invention will be evident from the following detailed description of the inventions and of specific embodiments thereof.

DESCRIPTION AND DISCUSSION OF THE INVENTION

It has long been recognized that gold and platinum group metals are often found in association with heavy, dark-colored, iron-containing minerals such as those forming the black sand portion of alluvial deposits or placer gravels. Platinum group metals include platinum, palladium, iridium, rhodium, osmium and ruthenium. The platinum group metals, being classified in Group VIII of the Periodic Table along with iron, cobalt and nickel, display many of the same chemical characteristics as does iron. Consequently, platinum and other metals of the platinum group are often found alloyed or otherwise associated with iron and its compounds. Black sands comprise in large part the higher oxides and silicates of iron, titanium and chromium with iron generally being present in largest amount. Specific minerals found in black sands commonly include magnetite, chromite and other spinels; especially those of iron and aluminum, ilmenite, hematite, olivine, garnet, corundum and quartz. Particles of metallic gold are often present as well as occasional platinum metal particles depending upon the source of the black sands. Basic igneous rocks often contain a similar suite of minerals and occasionally contain appreciable amounts of precious metals as do pyroclastic rocks as well.

Minerals containing tellurium, the rare earths, bismuth and other heavy metals are occasionally found as constituents of placer deposits in certain areas, as for example, the southwestern United States. In nature, tellurium forms minerals with gold, silver, mercury, bismuth, nickel, lead, copper and platinum. In all, some forty or more tellurium minerals are known. Because of their high specific gravity, the tellurium and rare earth minerals tend to be concentrated with the precious metals.

Those minerals commonly found in black sands and similar concentrates are known to be quite refractory and difficultly fusible in the conventional fire assay. In fact, both magnetite and hematite are infusible at the temperature attained during the ordinary fire assay, can remain suspended as particles within the slag, and tend to prevent the coalescence of the lead collector metal. Further, it is known that the presence of appreciable amounts of ferric oxide in the slag causes the retention of significant amounts of gold and silver within the slag.

It is common practice to adjust the composition and ratios of fluxing reagents used in the fusion charge to a fire assay so as to solubilize or flux the ferric iron compounds. That is ordinarily done by making available during the fusion a sufficient quantity of reducing agents, typically from a carbon source such as flour together with the metallic lead derived from reduction of the litharge, to reduce all of the ferric iron to the ferrous state. It is also necessary that enough silica be present in the slag to form bisilicates with the ferrous oxides and with all other bases from the flux and ore. Hence, essentially all of the iron contained in the sample being assayed reports to the slag in the form of an iron silicate. A base metal, usually lead but sometimes copper or mixtures of copper and lead, is included within the furnace charge to collect and retain the precious metals. Often the base metal is added as a base metal precursor, usually a lead oxide, which is at least partially reduced to the metal by the reducing agent during fusion. Specific procedures for the fire assay of black sands and similar samples can be found in the literature. One such procedure is set out in Report of Investigations No. 3265, "Assay of Black Sands", Paul Hopkins, U.S. Department of the Interior, Bureau of Mines, December, 1934. A most useful treatise on fire assaying in general is "A Textbook of Fire Assaying", Edward E. Bugbee, Third Edition, 1940, Colorado School of Mines Press. That text directs specific attention to the assay of black sands on pages 207–210.

Conventional procedures for the assay of black sands and ores containing a similar grouping of minerals are effective in extracting the precious metals which are contained in the sample in particulate metallic form. The assay results further conform reasonably well with the precious metal recovery obtained by conventional extraction techniques such as chemical leaching and the like. However, it is now coming to be recognized that some high iron-containing ores and ore concentrates include amounts of precious metals which do not show up in an ordinary fire assay and are not extractable by available chemical leaching techniques. Instrumental analyses by atomic absorption spectroscopy and like techniques upon a chemical extract of the ore suffer from extreme interferences from the high quantity of iron ordinarily present in the extract and have not proven to be reliable.

One explanation that has been advanced for this apparent anomaly is that gold and other precious metals are present in the form of very tiny particulate inclusions, on the order of a micron or so in diameter, within individual mineral grains. Note that ores are seldom ground finer than about 200 mesh for either assay or chemical leaching. A particle just passing a 200 mesh screen has a diameter of about 75 microns. Physical liberation of such tiny inclusions would require grinding the entire ore mass to a particle size on the same order as that of the inclusions; a task which is conceptually possible but not economically feasible. Those tiny particulates are too small to settle from the slag and the chance of such a small particle coming into contact with and being captured by a relatively large globule of lead derived from litharge reduction is remote. Hence, it is postulated, much of the precious metals content of the sample remains in the slag. It is further evident that, if precious metals are present in the form of tiny inclusions within mineral grains, then those metals are mostly not available for extraction by chemical leaching as the leach liquid is not able to contact the metallic inclusions.

Another explanation that has been advanced for the apparent anomaly sometimes observed between assay results and actual precious metals content of a sample is that gold and other precious metals are complexed with minerals such as titanates and iron-aluminum silicates contained in the ore. Further, rather than being merely complexed, there is at least some evidence that precious metals, particularly the platinum group metals, can occur chemically bound within the molecules of an ore mineral. If this is in fact the case, then the mineral molecule itself must be decomposed in order to free the molecules of precious metals. Thereafter, there must be provided some efficient mechanism for collecting the freed molecules of those metals and to separate the collected metal from the slag. The lead collector of the conventional fire assay is inadequate for that purpose.

In contrast to past practice in the extraction and assay of iron-containing precious metal ores, the present invention generates a collector metal comprising iron from the ore itself. In past practice a collector metal, lead in the case of the conventional fire assay and copper or lead in the approach taken by White in his U.S. Pat. No. 4,892,631, was fused with the ore to collect and contain the precious metals. Reduction of the iron compounds to metallic iron was carefully avoided. Instead, iron compounds were reduced to the ferrous state and were incorporated within the slag primarily as iron silicates. Precious metals, if present either as microscopic inclusions or in chemically bound form, tended to report with the slag. In those cases where ferric oxide has been suggested as a collector for platinum group metals, its use has been limited to an amount well less than 10% of the concentrate weight.

In the process of the present invention, an iron-containing ore or ore concentrate is subjected to fusion at conditions sufficiently severe to reduce at least half, and preferably substantially all, of the iron compounds to metallic iron. An iron-embrittling metal or metal precursor is included within the furnace charge in an amount sufficient to render the metallic iron produced in the process easily broken and comminuted. The iron-embrittling metal may comprise any metal which mixes with iron to form iron alloys which are brittle at ambient temperatures and thus are easily shattered by impact. The amount of embrittling metal required to produce an easily comminuted ingot depends upon the composition of the furnace charge and typically may range from about 100 ppm to 1% or more. Exemplary iron-embrittling metals include tellurium and other heavy metals such as the rare earths. Those metals may comprise a metal precursor such as a naturally occurring ore mineral, for example, the heavy metal tellurides, or the embrittling metal may be added to the furnace charge either in elemental form or as a compound. The temperature of the reaction must be maintained sufficiently high to obtain and maintain the metallic iron in liquid form. Pure iron melts at about 1,535° C. but many of its alloys display somewhat lower melting points so a reaction temperature ranging from about 1,500° to 1,600° C. is ordinarily appropriate. Conventional solid reducing agents, such as coke, coal, charcoal, and even flour or corn meal, are used in the process with coke, coal and charcoal being preferred. Gaseous reductants such as carbon monoxide may be used as well but are less preferred because of the greater difficulty in handling gases in the reduction furnaces. The addition of suitable fluxing agents is also necessary for efficient use of the process. Fluxes appropriate for use are those which react with silica and silicates contained in the ore to produce a lower melting, fluid slag. Examples of suitable fluxing agents include lime, limestone, sodium carbonate, sodium borate and the like, often used in combination. It is desired here to obtain a very fluid slag at the reaction temperature so as to facilitate as much as possible the settling of the reduced metallic iron and its separation from the slag. Specific flux compositions can be routinely tailored to the specific ore being processed by means of a few trial fusions.

Small assay-size quantities, typically 20 to 200 grams, of sample may be processed in a laboratory furnace capable of reaching temperatures of at least about 1,550° C. In such cases the fusion is conducted in a graphite or other crucible capable of withstanding the reaction temperatures. When the process is conducted on a larger scale, it is preferred that the furnace used to carry out the process be electrically heated so as to avoid the production of large gas volumes which ordinarily would require cleaning. Either carbon arc or induction furnaces are satisfactory for this purpose and are ordinarily operated in a batch fashion. In operation, a charge consisting of a proportioned mixture of ore, iron-embrittling agent, fluxing agent and reductant is loaded into the furnace and the charge is brought to a temperature high enough to melt the iron reduced from the ore. The charge is held at that temperature for a time sufficient to attain the desired degree of reduction of the iron compounds and to allow the metallic iron so produced to separate from the slag and migrate to the bottom of the furnace. It is preferred that the charge be held at temperatures above the melting point of the reduced iron for at least one-half hour and more preferably at least about an hour. Shorter reaction times can reduce the yield obtained by the process.

After reduction is complete the metal product of the furnace charge is poured into molds, cooled, and the slag is broken away from the metal. The slag is usually discarded but some or all of the slag may be retained for re-assay. In some instances, particularly when using an induction furnace, it is useful to retain a heel of metal within the furnace to couple with the field produced by the induction coil and so begin the heating of a new charge. After cooling in the mold, the metal ingot obtained as a product will typically show a high degree of crystallinity. The metal ingot is very brittle and can be shattered by a sharp blow with a hammer. That brittleness permits the metal product to be easily comminuted thus facilitating further processing to additionally concentrate the precious metals contained in the iron. Further processing of the metal ingot product obtained often requires its dissolution. That is particularly true in the circumstance in which this process is used as an assaying procedure. Massive iron ingots are difficult and slow to dissolve due at least in part to the limited surface area available for contact with the solvent.

Further processing of the iron ingot product may comprise electrorefining in which the iron is used as the anode of an electrolytic cell operating in normal fashion to dissolve iron into an electrolyte and plate it upon a cathode leaving a sludge or mud containing the precious metals. Alternatively, the iron product may be subjected to chemical dissolution using, for example, hydrochloric or sulfuric acid to dissolve iron and other base metals but to leave at least most of the precious metals as an undissolved residue. This latter technique is less preferred as it produces large quantities of iron salt solutions which require appropriate disposal or further treatment. Further, certain of the platinum group metals, particularly palladium, tend to display a significant degree of solubility in acids and such solubilized metals are not easily recoverable.

The following example will serve to further illustrate the process of the present invention and the advantageous results obtained through its use.

A magnetic concentrate was obtained from ore samples of an alluvial deposit located in southwestern New Mexico. The magnetic concentrate contained iron spinels and a number of heavy, dark minerals of undetermined composition. Included within those minerals of undetermined composition were tellurides of uncertain mineralogy. A portion of the magnetic concentrate amounting to 190 grams was mixed with about an equal weight of a sodium borate flux and about 50 grams of head ore which was added to provide a silica balance to the flux. Approximately 40 grams of reducing agent consisting of equal parts of flour and carbon in the form of lampblack was mixed with the ore concentrate and flux and placed in a graphite crucible.

The crucible charge was capped with lampblack carbon and was placed in an electric resistance heated furnace. The crucible holding the charge was surrounded with smaller graphite crucibles filled with graphite as an aid in maintaining a reducing atmosphere within the furnace. The furnace was then brought to fusion temperature in a series of steps; to 700° C. over the first 20 minutes, to 1,200° C. over the next 40 minutes, to 1,550° C. over the next twenty minutes and was then soaked at a temperature of about 1,550° C. for about an hour. The furnace temperature was then reduced to 1,300° C. and the crucible contents were poured into a mold which had been warmed to about 400° C. After cooling, the slag was separated from the iron ingot product and the ingot was weighed. Ingot weight was about 102 grams, or about 53.7% of the weight of the concentrate making up the charge. Were one to assume that the entire amount of concentrate used in the charge was magnetite, then the theoretical yield would be about 137 grams. That calculation shows that most of the iron contained in the sample, certainly more than 75%, had been reduced to metallic iron.

The iron ingot was first examined by microscope. It showed a high degree of crystallinity with definitive grain boundaries between the crystals. A sharp blow with a hammer shattered the ingot, demonstrating its extreme brittleness. A portion of the shattered ingot was further comminuted and was then subjected to acid dissolution followed by analysis using interference corrected atomic absorption spectroscopy to determine the precious metal content of the bar. Analytical results obtained, reported in troy ounces per ton of precious metals contained in the iron ingot, are as follows:

| | |
|---|---|
| Gold: | 5.4 ounces per ton |
| Platinum: | 0.5 ounces per ton |
| Palladium: | 2.3 ounces per ton |
| Rhodium: | 1.4 ounces per ton |

No analysis was performed for the other platinum group metals, osmium, iridium and ruthenium. When the same samples are analyzed using conventional fire assay techniques, there is obtained a bead showing, at best, a few tenths of an ounce per ton of total precious metals.

As can be seen, the method of this invention provides considerable benefit and advantage to the extraction of precious metals from iron-containing ores and to their assay. While the invention has been shown and described with reference to certain preferred embodiments, other modifications of the process will be readily apparent to those skilled in the art.

I claim:

1. A method for the assay and recovery of gold and platinum group metals from complex ores and concentrates containing oxidized iron compounds comprising:

preparing a charge consisting essentially of said iron-compound containing ore together with fluxing agents, a reducing agent, and an iron-embrittling agent, said fluxing agents selected to react with gangue constituents of said ore to produce a slag having a melting point substantially below that of said gangue constituents and said iron-embrittling agent comprising a metal or metal precursor which, when alloyed with iron, imparts brittleness to an iron ingot when cold;

subjecting said charge to a fusion reaction at conditions sufficiently severe to reduce at least at least a portion of said iron compounds contained in the ore to metallic iron and to alloy said iron-embrittling agent with said iron, said conditions including a temperature sufficiently high to obtain and maintain said metallic iron in the liquid state for a time long enough to allow substantial separation of said metallic iron from said slag;

cooling and solidifying said metallic iron to form a brittle alloy; and separating precious metals therefrom.

2. The method of claim 1 wherein said reducing agent is a solid, carbon-containing material.

3. The method of claim 2 wherein said reducing agent is selected from the group consisting of coke, coal and charcoal.

4. The method of claim 1 in which the temperature of said fusion reaction is above about 1,500° C.

5. The method of claim 1 in which said brittle alloy is comminuted and wherein precious metals of the platinum group are separated therefrom.

6. The method of claim 1 in which said ore contains iron spinels and iron-embrittling minerals.

7. The method of claim 6 wherein said minerals comprise tellurides.

8. The method of claim 1 in which said fluxing agents are reactive with silica to form a fluid slag at the temperature of said fusion reaction.

9. The method of claim 8 wherein said fluxing agents are selected from the group consisting of lime, limestone, sodium carbonate, sodium borate and mixtures thereof.

10. The method of claim 1 wherein precious metals are electrolytically separated from said iron by making said iron the anode of an electrolytic cell, recovering iron and other base metals upon the cathode of said cell, and recovering said precious metals as a residual sludge.

11. The method of claim 1 wherein precious metals are separated from said iron by subjecting said iron to a chemical dissolution by a reagent which selectively dissolves base metals leaving an undissolved residue comprising precious metals.

12. In a method for the fire assay for precious metals of an ore containing iron spinels in which a base metal comprising lead or copper or a base metal precursor comprising a lead oxide is added to the assay charge to function as a collector for precious metals contained in the ore during fusion thereof and wherein fluxing agents reactive with iron oxide are added to the assay charge to form a slag with said iron oxides, the improvement comprising:

substituting an internally generated collector metal for the base metal or base metal precursor collector metal of said conventional fire assay; said internally generated collector metal comprising metallic iron obtained during fusion of said assay charge through the reduction of at least a portion of said iron spinels at conditions whereat metallic iron is obtained in liquid form;

including within the assay charge an iron-embrittling agent, said agent comprising a metal or metal precursor which, when alloyed with iron, imparts brittleness to the iron when cold;

separating said metallic iron from gangue residues of said ore to obtain a brittle iron ingot; and comminuting said ingot and determining the concentration of precious metals contained therein.

13. The process of claim 12 wherein said iron-embrittling agent comprises tellurium or a tellurium compound.

14. The process of claim 12 wherein one or more fluxing agents reactive with silica are added to said assay charge, said fluxing agents selected from the group consisting of lime, limestone, sodium carbonate, sodium borate, and mixtures thereof.

15. The process of claim 12 wherein said fusion is carried out at a temperature above about 1,500° C.

16. A process for the extraction and recovery of precious metals, including gold and the platinum group metals, from black sands which contain iron spinels and other heavy iron-containing minerals comprising:

mixing said black sands with a solid carbon-containing reducing agent, at least one fluxing agent reactive toward silica, and an iron-embrittling agent to form a furnace charge;

subjecting said furnace charge to a fusion reaction at a temperature above about 1,500° C. for a time sufficient to reduce at least a portion of said iron spinels to liquid metallic iron and to allow separation of said metallic iron from the slag formed by reaction of said fluxing agent and siliceous gangue components of said black sands whereby precious metals are freed from said ore and are collected within said liquid iron; and cooling said liquid iron to form a brittle solid and separating precious metals therefrom.

17. The process of claim 16 wherein said iron-embrittling agent comprises a metal or metal precursor which, when alloyed with iron, imparts brittleness to said iron.

18. The process of claim 17 wherein said embrittling agent comprises tellurium or a tellurium-containing compound.

19. The process of claim 18 wherein said tellurium-containing compound is a naturally occurring telluride mineral.

20. The process of claim 16 wherein said fluxing agent is selected from the group consisting of lime, limestone, sodium carbonate, sodium borate and mixtures thereof.

* * * * *